United States Patent [19]

Williams et al.

[11] Patent Number: 4,721,257

[45] Date of Patent: Jan. 26, 1988

[54] ROTARY SHREDDING APPARATUS

[75] Inventors: Robert M. Williams, Ladue, Mo.; Harold J. Groves, Granite City, Ill.

[73] Assignee: Williams Patent Crusher and Pulverizer Company, St. Louis, Mo.

[21] Appl. No.: 937,975

[22] Filed: Dec. 4, 1986

[51] Int. Cl.[4] ..... B02C 25/00

[52] U.S. Cl. ..... 241/36; 241/37.5; 241/236

[58] Field of Search ..... 241/36, 32, 30, 37.5, 241/235, 236; 60/403, 476, 911

[56] References Cited

U.S. PATENT DOCUMENTS 4,034,918 7/1977 Culbertson et al. ..... 241/236 X

OTHER PUBLICATIONS

Hedland Series Flow Meters, Form #000142, 2-1984.

*Primary Examiner*—Mark Rosenbaum

*Attorney, Agent, or Firm*—Gravely, Lieder & Woodruff

[57] ABSTRACT

A rotary shredding apparatus having in combination counterrotating cutter supporting shafts operated by a reversible fluid pressure driven motor, and a fluid flow circuit connected to the reversible motor and including a pump supplied source of fluid at a predetermined nominal operating flow rate, a fluid pressure responsive relief valve operative for fluid flow exceeding said predetermined nominal operating flow rate to return fluid to the source, and a fluid flow directing valve connected in fluid flow relation between said relief valve and said fluid driven motor, and control connected to said fluid flow directing valve means; a fluid flow rate detecting sensor disposed in said hydraulic fluid flow circuit between said fluid flow directing valve and said pressure responsive relief valve, whereby upon the fluid flow rate detecting sensing fluid flow reduction at from about 5% to 10% of said predetermined nominal operating flow rate in said fluid flow circuit said fluid flow detecting sensor energizes said control means to stop said motor means and establishes that the flow directing valve dial moved to reestablish flow.

6 Claims, 3 Drawing Figures

ROTARY SHREDDING APPARATUS

BACKGROUND OF THE INVENTION

1. Field of the Invention

This invention relates generally to rotary shredding apparatus operated by one or more reversible hydraulic pressure operated motors, and is particularly directed to an improved system of control to safeguard the apparatus against operational malfunctions.

2. Description of the Prior Art

The presently known prior art relating to material shredding apparatus of rotary type driven by hydraulic fluid pressure motors or by electrical motors includes such examples as are disclosed in U. S. Pat. Nos. 3,502,276, Panning et al of Mar. 24, 1970; Schwarz 3,845,907 of Nov. 5, 1974; Goldhammer 3,860,180 of Jan. 14, 1975; Cunningham et al 3,868,062 of Feb. 25, 1975; Kaczmarek 3,981,455 of Sept. 21, 1976; Culbertson et al 4,034,918 of July 12, 1977; and Williams 4,452,400 of June 5, 1984.

In shredder apparatus operated by relatively high pressure systems connected to reversible motors, there is a need for a system that is able to sense the incorrect operation of control devices in the pressure lines so that upon malfunctions of any component in the forward or reverse mode of operation of the drive motor the apparatus will be shut down before serious and expensive damage is caused.

BRIEF SUMMARY OF THE INVENTION

The primary object of the present invention is to incorporate a hydraulic fluid flow detecting device in the control system of a shredder drive for forward or reverse directions of rotation of the shredder to protect the apparatus against damage from high pressure fluid in the event of a malfunction of any component in the system.

An equally important object of the present invention is to incorporate in the control system a hydraulic flow sensitive switch which will detect a condition of at least a minimum fluid flow and certainly no hydraulic fluid flow in the conduit system, and communicate that information to the control means.

The invention is embodied in an improvement which utilizes a fluid flow sensor in the hydraulic system associated with a rotary shredding apparatus, whereby the fluid flow sensor will detect a malfunction of the valve which directs forward and reverse fluid delivery to the shredder drive motor, or a malfunction of the pressure relief safety value, or a malfunction of a fluid filter, or any happening in the hydraulic system that results in at least a minimum fluid flow and certainly no fluid flow at the location of the sensor.

BRIEF DESCRIPTION OF THE DRAWINGS

A presently preferred embodiment of the ripshear shredder apparatus has been illustrated in the following drawings, wherein.

DETAILED DESCRIPTION OF THE PREFERRED EMBODIMENTS

Figure 1:
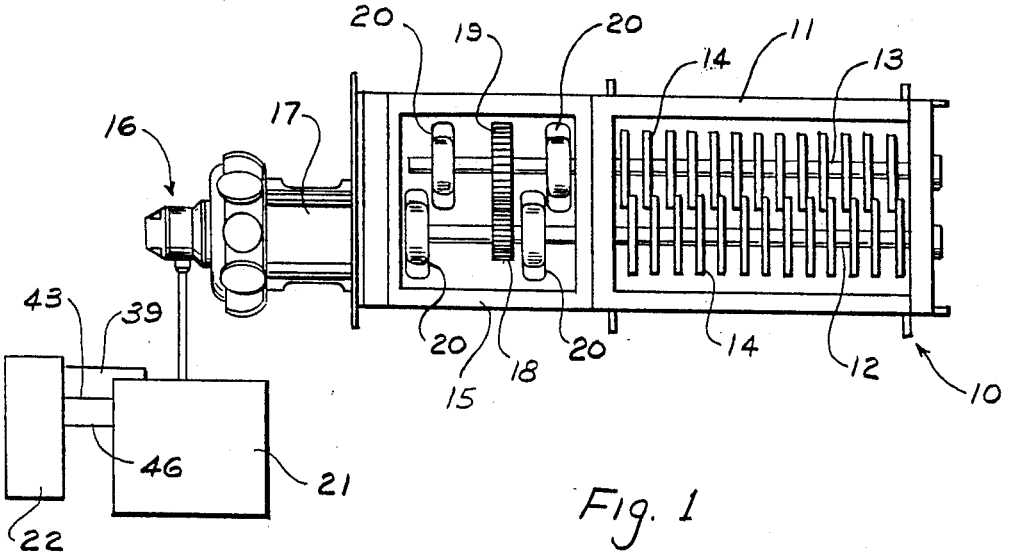
FIG. 1 is a simplified plan view looking down on a ripshear shredder apparatus showing schematically a single hydraulic motor drive through a gear transmission to the oppositely rotated shafts for the disc-type cutters.

FIG. 1 illustrates a shredder apparatus 10 having a frame 11 in which oppositely rotating shafts 12 and 13 are mounted to carry cooperating disc-type cutters 14. A gear type transmission assembly 15 is associated with the shafts 12 and 13, and a single radial piston hydraulic drive motor 16 is connected by a coupling bracket 17 to the assembly 15. The transmission is equipped with a train of gears 18 and 19 supported by suitable bearing blocks 20. The shaft for the gear 18 is directly connected to the radial piston motor 16 and rotates the shaft 12 at a first speed which is different from the speed of the second shaft 13. It is preferred that shaft 12 has a higher speed than the shaft 13 so that the disc-type cutters will effectively rip, tear and break material thrown into a hopper (not shown) carried by the frame 11 to direct such material into the cutters 14.

Figure 2:
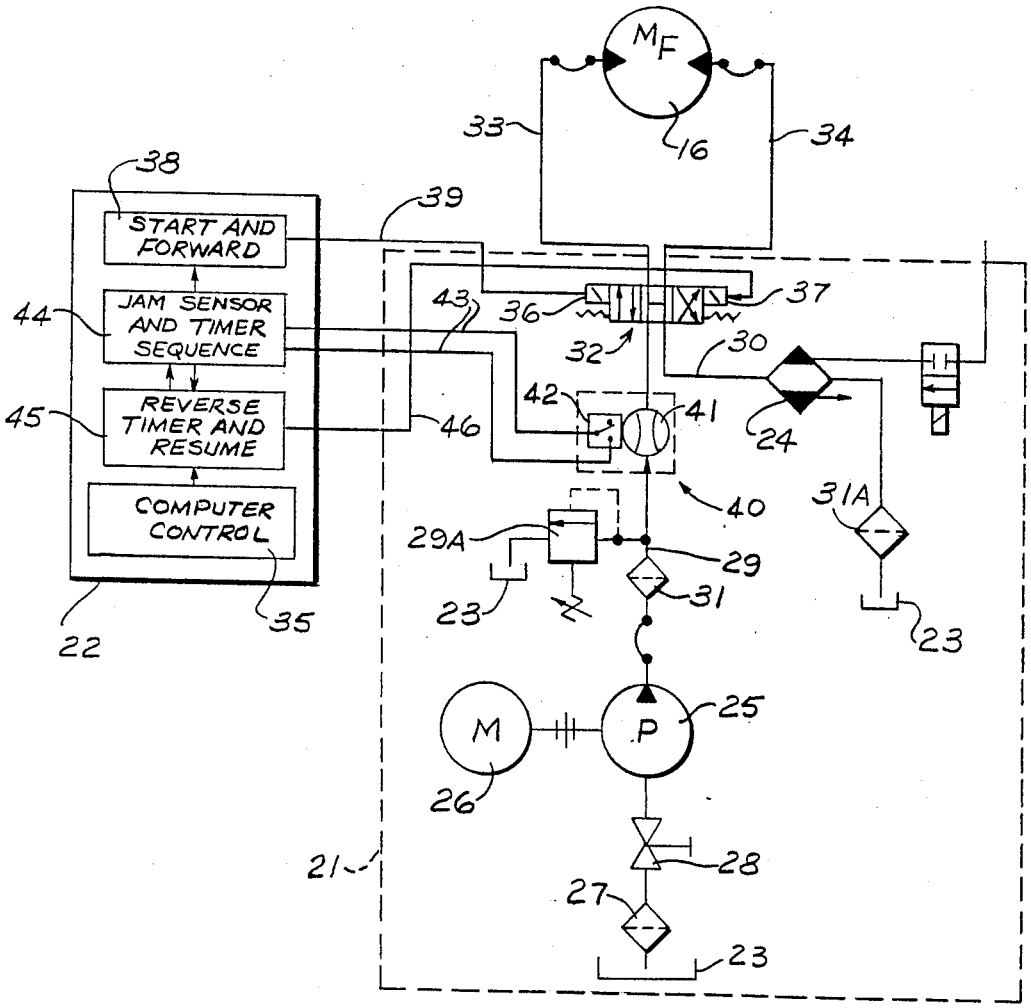
FIG. 2 is a schematic hydraulic and associated control system operatively related to the motor drive for the shredder apparatus seen in FIG. 1, the control system including a hydraulic flow sensitive means for monitoring the hydraulic motor drive to institute reversal thereof as the occasion demands.

With reference to FIG. 2, the motor 16 seen in FIG. 1 is operated by the control system which comprises a hydraulic power pack 21 and a power supply 22. The hydraulic power pack 21 includes a reservoir 23 for the hydraulic fluid, and a water type hydraulic fluid cooler unit 24 associated with the hydraulic pump 25 driven by electric motor 26. The pump draws its fluid from the reservoir 23 through a filter 27 and shut-off valve 28. The delivery side of the pump 25 is connected through a filter 31 to a pressure supply conduit 29, while the fluid return is through a conduit 30 to the water cooled cooler 24 which returns the fluid through a filter 31A to the reservoir 23.

As seen in FIG. 2, the hydraulic supply conduit 29 and the hydraulic return conduit 30 are connected into a flow control valve means 32. That valve means 32 has fluid conduit connections 33 and 34 into the radial piston hydraulic motor 16. Valve means 32 is a 4-way 3 position solenoid operated and spring centered hydraulic valve. The direction of rotation of the motor 16 is determined by the internal position of the spool in the valve 32. The fluid supply side of the pump through the conduit 29 is under pressure, and to protect against overload at the pump, pressure relief valve 29A is shown connected to conduit 29 and provided with a conduit back to the reservoir 23. That flow back to the reservoir 23 is only available if the pressure in conduit 29 tries to exceed the pressure setting of the relief valve 29A, as is well understood in the hydraulic art. The relief pressure setting at the valve 29A can be set to allow the motor 16 to generate maximum torque and energy at the shafts 12 and 13 so the full load of the motor 16 can be available for the shredding operation.

The direction of rotation of the motor 16 is directly under the control of a power supply 22 which includes a computer 35 arranged to operate the flow control valve 32 through a predetermined program of sequential energization of solenoids 36 and 37 associated with the shiftable spool (not shown) in valve 32. Normally, the valve 32 assumes a position with its spool in centered position so that the motor 16 will not operate when the pump 25 is started. At this start up time the solenoids 36 and 37 are not energized. When the shredder 10 is operated, the computer start and forward control circuit 38 is initiated and a signal is transmitted by lead 39 to solenoid 36 which causes the valve spool to move such that the flow of pressure fluid in conduit 29 is admitted to conduit 33 and to the motor 16 while the return flow of fluid occurs in conduits 34 and 30 and back to the reservoir 23. While the motor 16 responds to the flow of hydraulic fluid forced under pressure through conduits 29 and 33, any tendency for the motor 16 to stall upon encountering resistance in the shredder 10 has been heretofore made subject to a protective control based upon an increase in pressure in conduit 29 (per Culbertson et al U.S. Pat. No. 4,034,918) at a value less than the safety relief pressure setting at valve 29A. Protective control has also been based on a motion responsive proximity switch in an electrical circuit (per Williams U.S. Pat. No. 4,452,400) such that reversal of the motor 16 could be effected by lack of motion without regard to the pressure value in conduit 29.

There is a further control system for shredders of the general character disclosed in this application. Reference is directed to Burda U.S. Pat. No. 4,560,110 which is based upon current drawn by the electric motor driving the hydraulic fluid pump. A sensor in the motor circuit senses the load on the motor.

An even simpler control with a greater scope of protection has been discovered. This control is based, not on pressure or movement in the shredder drive motor 16 or shafts 12 and 13, but on the rate of flow of fluid at the device 40 connected into conduit 29. The device 40 is an efficient and trouble free flow rate indicator inserted in the conduit 29 so its flow rate response through the orifice 41 can operate a switch 42 when the flow reaches a predetermined low value through the orifice 41. The device 40 does not care what the pressure is and does not respond to pressure, but is solely responsive to the rate of hydraulic fluid flow.

A suitable flow rate responsive means 40 with control switch 42 is made by Hedland, Division of Racine Federated, Inc. of Racine, Wis., and embodies an orifice piston containing a magnet carrying piston inside the flow meter body. The piston is spring urged in opposition to the direction of fluid flow to return the piston to a no flow position. A fixed metering cone cooperates with the movable piston, and an external movable indicator on the body of the device moves responsively with the piston magnet to actuate a switch 42 connected into a circuit 44 in the power supply 22. The flow rate or flow responsive means 40 is shown in a symbolic rendering which is intended to depict the above structure. The system in which the flow rate indicator means is installed is intended to operate at a predetermined nominal rate of hydraulic fluid flow sufficient to drive the shredder motor up to whatever pressure is allowed by a safety pressure responsive valve 29A. When the shredder encounters an object that is extremely hard to shred, the fluid flow to the motor 16 decreases independently of the pressure. The motor 16 will try to shred that object, but if the flow of fluid decreases to about ten percent (10%) or less of the predetermined nominal flow rate, the flow rate responsive means will respond to that low flow rate and close the switch 42 to alert the programmable control in the power supply 22 to try and shift the valve 32 into a reversing mode of the motor 16. When that flow decreases it can foretell the occurrence of a problem in the hydraulic system. For example, it can sense the shredder motor 16 has encountered an impending jam due to an ineffective rate of rotation, or has stopped due to the resistance encountered in the shredder by a tough object that has jammed the cutters.

When a jam occurs to stop rotation that means that hydraulic fluid flow has stopped, except for intentional leakage in the motor 16. In this event, the switch 42 will close and through a two wire lead 43 connected to the power supply 22 will initiate a timing response in the circuit 44 to measure the duration of that lack of or reduced hydraulic fluid flow. If the timing period is not exceeded, it means the jam condition has been overcome and the predetermined nominal flow rate will be restored so that normal function of the forward rotation of the motor 16 will resume. If, on the other hand, the time is exceeded, the switch 42 will open and circuit 44 will cause deenergization of the solenoid 36 so the valve 32 will seek its neutral position and dump the pressure fluid in conduits 33 and 34 back to the reservoir 23. The next sequential step is for the power supply 22, and the computer therein to determine if there is hydraulic flow at the device 40, and this is done by reason of determining whether the switch 42 has remained open or has closed. If the switch 42 has remained open, there will be fluid flow back to the reservoir 23 because the valve 32 has functioned properly. If the valve 32 has not functioned properly, there will be no flow sensed at the device 40 and the switch 42 will close and an alarm will be triggered. This is a good example of the uniqueness of the device 40, because if the valve 32 has not functioned properly it will be dangerous to attempt to reverse as the valve might be in a jammed position at the time when the fluid pressure in line 33 is at its maximum, and to energize solenoid 36 would develop a severe hydraulic shock. The ideal condition of the hydraulic pressure system is one in which there is flow through the device 40 so as to maintain the switch 42 in its normal open condition. If the shredder motor 16 encounters a jam, the device 40 will sense a stoppage of flow fluid which will trigger the power supply 22 to deenergize solenoid 36 and send the valve 32 back to its neutral position. If the valve reaches its neutral position, flow through the device 40 will immediately resume and the pump will continue to operate. At the time the power pack will energize solenoid 37 to shift the valve 32 into its reversing position for the preset time in the device 45, and after the time has expired solenoid 37 will be deenergized so that the valve 32 will return to its neutral position. If the flow through 40 is sensed under this condition, it will indicate that the valve 32 has moved properly to dump the pressure fluid from lines 33 and 34 back to the reservoir before the forward rotation of the drive motor 16 is initiated by energizing solenoid 36.

The flow rate device 40 takes note of the stopping of motor 16, as flow in conduit 29 has reduced to or nearly to zero gallons per minute. Since the radial piston hydraulic motor is a positive displacement motor no fluid flows through the motor when it has stopped, except for a slight leakage past the internal clearances around the pistons and shafts. The device 40 is unique in its simplicity.

Figure 3:
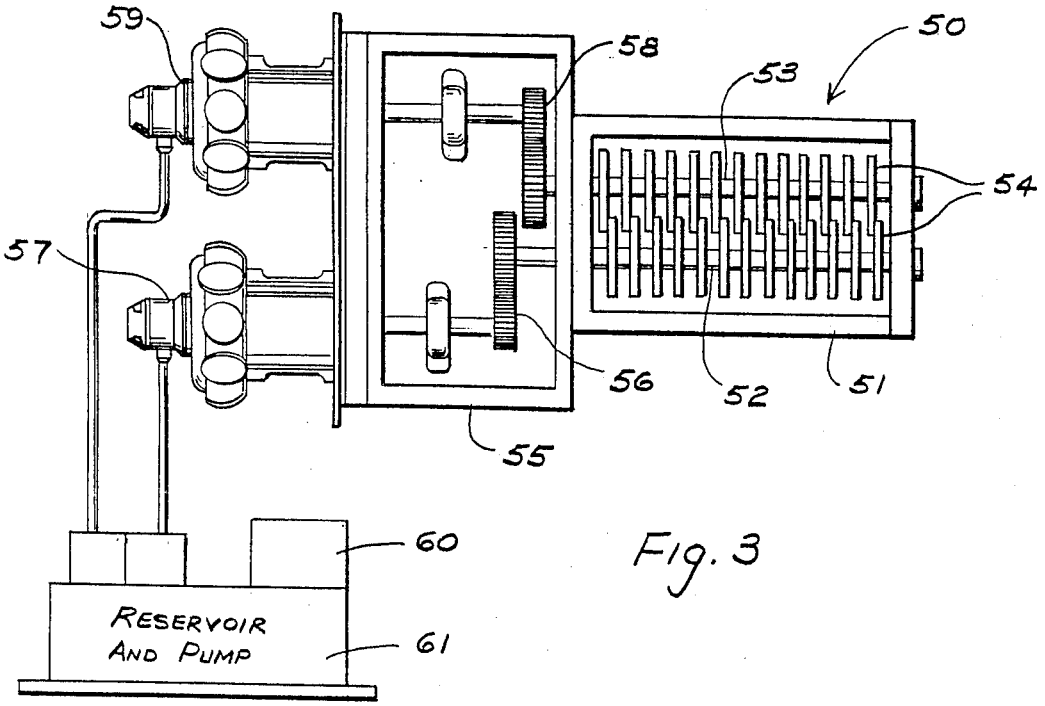
FIG. 3 is a further simplified plan view of a ripshear shredder apparatus having a twin hydraulic drive through a geared transmission to a pair of disc-type cutter driving shafts.

Turning now to FIG. 3, there is shown a shredder apparatus 50 having a frame 51 in which oppositely rotating shafts 52 and 53 are mounted to carry cooperating disc-type cutters 54. A suitable transmission assembly 55 is attached to the frame 51 to house a gear assembly 56 for a radial piston hydraulic drive motor 57, and a second gear assembly 58 for a second radial piston hydraulic drive motor 59. This arrangement is adopted for shredding apparatus of large sizes requiring power rating of 500 or more horsepower. Here again, the shafts 52 and 53 are rotated at different rates so that the desired ripping, tearing and breaking action occurs. The view of FIG. 3 is seen to include a control system arranged in a box 60 mounted on or adjacent a pump and hydraulic fluid reservoir unit 61. The control system in box 60 is not illustrated as it merely duplicates the disclosure of FIG. 2. Each radial piston hydraulic motor 57 and 59 has its own control, including a flow sensor of the character seen at 40. In view of the repetitiousness of the control system for a dual radial piston motor drive it is deemed unnecessary to burden this specification with two more drawings.

The uniqueness of the present control system is the provision of a fluid flow sensor 40 which is placed in a primary fluid flow conduit 29 at a place where a malfunction event in the system will be detected. There are several components in the system seen in FIG. 2 that could develop a malfunction, and the examples include the following:

A. If the shredder 10 encounters an object that stalls the radial piston motor 16 there will be a stoppage of flow in conduit 29 sufficient to cause the switch 42 in the device 40 to open its circuit 43 to the timer circuit 44 which will be picked up at the computer 35 to initiate the reversal cycle of the solenoid valve 32. It is assumed, of course, that the valve 32 will function properly to go to its neutral position influenced by springs, and after a pause be moved to reverse the fluid flow. In this sequence as soon as the stall condition is detected by the device 40 the solenoid 36 will be deenergized to allow the valve to go to neutral before going into a reverse flow position on energization of solenoid 37.

B. If the spool in valve 32 sticks in the forward run position, due to dirt in the valve, and the shredder motor 16 stops, the computer control 35 will try to initiate a motor reversing cycle by deenergizing solenoid 36 so the valve means 32 will go to neutral. If it cannot cycle the valve to neutral the shredder will be shut down. If, on the other hand, the valve 32 can go to neutral, flow in conduit 29 will be detected and the computer control 35 will effectively cause the reversing solenoid 37 to shift the spool into a reversing position for the time permitted before it will go to neutral and then into forward run position to supply pressure fluid to conduit 33.

C. On the valve 32 shifting from a reversing flow setting upon deenergization of its solenoid 37, the device 40 will check for flow in conduit 29 and if there is flow the valve solenoid 36 will be reactivated and the control will wait for the next jam.

D. During a reversal sequence, if for any reason, such as dirty hydraulic fluid or a mechanical failure, the valve 32 does not go into its neutral position it would be detrimental to continue the reverse cycle as a maximum hydraulic fluid pressure can still remain in the conduit and the dumping of the hydraulic fluid by activation of the solenoid 37 will cause a severe hydraulic shock. With the present detection device 40, the jam at the valve 32 will be detected after the reversing sequence has begun. If the spool in valve 32 jams in the forward mode there would be no flow detected at the device 40 and the computer 35 will shut down the system and sound an alarm, or activate a light.

E. What has just been explained when the system control of the valve 32 goes from forward to reverse will be true when the system control is sequencing in going from reverse to forward.

F. If the relief valve 29A fails in an open position there would be no or low flow at the device 40 and the system would be shut down.

G. Also, if a filter 31 or 31A should stop up or plug with dirt, the device 40 would detect no or low flow and initiate a system shut down.

The uniqueness of the present invention is understood to reside in a rotary shredding apparatus having counterrotating shafts with cooperating cutter elements for shredding material. The shafts are driven by one or a cooperating pair of fluid motors connected into a fluid flow circuit with a pump delivering a fluid flow at a predetermined nominal flow rate to a fluid flow directing valve subject to control means having a programmable computer for selecting forward shredding and reverse jam relief rotation. The fluid flow circuit is equipped with a flow relief valve that can adjust the upper pressure value in the circuit, and a flow rate sensor that is independent of pressure but is sensitive to the rate of fluid flow into the flow directing valve. The flow rate sensor functions with a normally open electric switch connected into the control means for causing the control means to operate the fluid flow directing valve on the first assumption that the apparatus has jammed which would stop fluid flow and call for reversal of the motor to unjam the cutter elements. If the assumption of a jam and corrective action by the control means does not reestablish fluid flow at the flow rate sensor, then there is an obvious malfunction of some other element in the fluid flow circuit. The malfunction may be due to a clogged filter or a leaking or broken conduit that would, in addition to a jam, result in a decrease of fluid flow to a rate of about 5% to 10% of the predetermined nominal flow rate for normal shredder operation.

What is claimed is:

1. In a rotary shredding apparatus having counterrotating cutter supporting shafts, reversible fluid pressure driven motor means connected to said shafts for driving said shafts in a forward shredding direction and for driving said shafts in a reverse direction to clear a jam in said apparatus, a hydraulic fluid flow circuit connected to said motor means and including fluid pump means to cause fluid flow in said fluid flow circuit at a predetermined nominal flow rate and fluid flow directing valve means in said fluid flow circuit in advance of said motor means, and control means connected to said flow directing valve means for sequencing said flow directing valve means in a forward shredding direction, or reverse jam clearing direction of said motor means, and for sequencing said flow directing valve means into a neutral position; the improvement therein comprising the combination of:

(a) a fluid flow rate sensing device in said fluid flow circuit between said pump means and said fluid flow directing valve means, said sensing device being rendered operative upon the sensing of a reduced rate of fluid flow of the order of about 10% of the predetermined nominal flow rate; and (b) means operatively connecting said sensing device with said control means on detecting said reduced rate of fluid flow for sequencing said flow directing valve means to its neutral position to determine the existence of a malfunction in the fluid flow circuit.

2. In a rotary shredding apparatus having counterrotating cutter supporting shafts operated by a reversible fluid pressure driven motor means, a fluid flow circuit connected to the reversible motor means and including a source of fluid, pump means for supplying fluid from said source at a predetermined nominal flow rate, a fluid flow directing valve means connected in fluid flow relation between said relief valve and said fluid driven motor means, said flow directing valve being movable to connect or disconnect fluid flow to said fluid driven motor means, the improvement comprising:

(a) control means connected to said fluid flow directing valve means to effect the movement thereof to connect or disconnect fluid flow to said fluid driven motor means; and (b) a fluid flow rate detecting sensor disposed in said fluid flow circuit in position to sense changes in the rate of fluid flow so that upon the fluid flow detecting means sensing a fluid flow rate reduction to about 5% to 10% of said predetermined nominal flow rate in said fluid flow circuit said fluid flow detecting sensor energizes said control means to disconnect said fluid flow to said fluid driven motor means for stopping said motor means.

3. In rotary shredding apparatus having counter-rotating reversible cutter shafts operably connected to a reversible hydraulic pressure fluid motor, the improvement of means for protecting the shredding apparatus against damage from pressure fluid malfunctions comprising:

(a) a hydraulic fluid flow circuit;

(b) fluid pumping means connected into said hydraulic fluid flow circuit for pressurizing the flow of fluid therein for developing a predetermined nominal flow rate for the fluid motor;

(c) fluid flow directing valve means interconnecting said fluid flow circuit with the pressure fluid motor, said valve means being operable sequentially into forward, neutral, and reverse positions for operating the fluid motor in forward, inoperative, and reverse modes;

(d) a fluid flow rate sensing device in said hydraulic fluid flow circuit between said pumping means and said valve means, said sensing device being rendered operative upon the sensing of a reduced rate of flow of hydraulic fluid of the order of about 10% of said predetermined nominal flow rate; and (e) control means interconnecting said sensing device with said valve means for sequencing said valve means whereby failure to return to said predetermined nominal flow rate indicates a malfunction in said hydraulic fluid flow circuit.

4. A rotary shredding apparatus comprising:

(a) counter-rotating shafts carrying cooperating cutter elements for shredding materal and reversible motor means operably connected to the counter-rotating shafts for driving the same in a forward shredding motion and in a reverse direction;

(b) fluid flow circuit means connected to said reversible motor and including a pump to supply fluid flow at a predetermined nominal flow rate through said fluid flow circuit means;

(c) fluid flow directing valve means connected into said fluid flow circuit means to direct the flow of fluid at said predetermined nominal flow rate to said reversible hydraulic motor;

(d) control means connected to said fluid flow directing valve for operating said fluid flow directing valve to direct the flow of fluid in a direction for effecting the drive of said reversible motor in a forward shredding direction, as well as in a reverse direction; and (e) a fluid flow detecting device connected into said fluid flow circuit means in advance of said fluid flow directing valve means, said device having an electrical switch means responsive to said fluid low rate and occupying a normally open position, said switch means having an electrical circuit connection into said control means, whereby upon a reduction in the predetermined nominal flow in said fluid flow system said fluid flow detecting device closes said normally open switch means to signal said control means to stop said motor means.

5. The rotary shredding apparatus according to claim 4 wherein said fluid flow detecting means operates said switch means independently of the fact that there is pressure in said fluid flow circuit.

6. A rotary shredding apparatus comprising:

(a) counter-rotating cutter support shafts connected to reversible fluid pressure driven motor means for driving said shafts in a forward shredding direction and for driving said shafts in a reverse direction to clear a jam in the cutters;

(b) fluid flow circuit means having operative components which comprise a pump having a suction side connected to a reservoir for the fluid and an output side connected to said motor means for delivering fluid at a predetermined nominal flow rate, fluid directing valve means in said circuit in advance of said motor means, and actuator means connected to said valve means for setting said valve means in a first position for supplying fluid to drive said motor means in a shredding direction while returning fluid back to said reservoir, for setting said valve means in a second position for directing fluid to drive said motor means in a jam clearing reverse direction while returning fluid back to said reservoir, and for setting said valve means in a neutral position for by-passing said motor means and recirculating fluid back to said reservoir;

(c) control means connected to said flow directing valve means for causing said valve means to assume said first, second and neutral positions selectively;

(d) a programmable control system connected to said control means and normally operable to initiate setting of said valve means in said first position; and (e) a fluid flow rate detecting device connected into said fluid flow circuit in advance of said flow directing valve means and provided with signalling means connected to said programmable control system for signalling the detection of the existence of a flow rate of less than the predetermined nominal flow rate or no flow of fluid in said fluid flow circuit whereby to initiate action by said programmable controller to call for reversal of said motor means to clear a jam, and to stop said motor means on the detection of low rate of or no flow of fluid back to said reservoir.

* * * * *

UNITED STATES PATENT AND TRADEMARK OFFICE

CERTIFICATE OF CORRECTION

PATENT NO. : 4,721,257

DATED : January 26, 1988

INVENTOR(S) : Robert M. Williams and Harold J. Groves

It is certified that error appears in the above-identified patent and that said Letters Patent is hereby corrected as shown below:

Column 8, line 10 cancel "low" and substitute therefor --flow--

Column 8, line 33 insert --flow-- in front of the word "directing".

Signed and Sealed this

Twenty-sixth Day of July, 1988

*Attest:*

DONALD J. QUIGG

*Attesting Officer*

*Commissioner of Patents and Trademarks*